US006725849B2

(12) United States Patent
Stegmaier et al.

(10) Patent No.: US 6,725,849 B2
(45) Date of Patent: Apr. 27, 2004

(54) OIL-SEPARATING DEVICE FOR CRANKCASE GASES IN AN INTERNAL COMBUSTION ENGINE

(75) Inventors: Juergen Stegmaier, Schwaebisch (DE); Bruno Hezel, Stuttgart (DE); Dietmar Uhlenbrock, Tecklenburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/343,648

(22) PCT Filed: Mar. 20, 2002

(86) PCT No.: PCT/DE02/01004

§ 371 (c)(1),
(2), (4) Date: Feb. 3, 2003

(87) PCT Pub. No.: WO02/099255

PCT Pub. Date: Dec. 12, 2002

(65) Prior Publication Data

US 2003/0150436 A1 Aug. 14, 2003

(30) Foreign Application Priority Data

Jun. 7, 2001 (DE) ..... 101 27 819

(51) Int. Cl.[7] ..... F01M 13/02
(52) U.S. Cl. ..... 123/572
(58) Field of Search ..... 123/572, 573, 123/574

(56) References Cited

U.S. PATENT DOCUMENTS 4,569,323 A * 2/1986 Okkumura ..... 123/572
5,944,001 A * 8/1999 Hutchins ..... 123/572
6,247,463 B1 6/2001 Holzmann
6,279,556 B1 * 8/2001 Busen et al. ..... 123/572
6,591,820 B2 * 7/2003 Kitano et al. ..... 123/572

FOREIGN PATENT DOCUMENTS

| | | |
|---|---|---|
| DE | 31 52 747 A | 6/1983 |
| DE | 196 42 219 A | 4/1998 |
| DE | 197 00 733 A | 7/1998 |
| DE | 197 03 770 C | 7/1998 |
| WO | 98/32955 | 7/1998 |

* cited by examiner

*Primary Examiner*—Marguerite McMahon
(74) *Attorney, Agent, or Firm*—Michael J. Striker

(57) ABSTRACT

The invention concerns an oil separator (2) for crankcase gases of an internal combustion engine, comprising a preliminary separator (28), a cyclone separator (30), a fine separator (32) and, if necessary, a valve device (36) that are provided in a cascade arrangement on a cylinder-head cover (4) of the internal combustion engine; in order to simplify the design of the oil separator and obtain easier installability, it is provided that the preliminary separator (28), the cyclone separator (30), the fine separator (32) and the valve device (36) provided, if necessary, are located on the outside (20) of the cylinder-head hood (4) and are covered by a housing half-shell (6) which, together with the outside (20) of the cylinder-head hood (4), forms a housing for the oil separator (2).

16 Claims, 6 Drawing Sheets

OIL-SEPARATING DEVICE FOR CRANKCASE GASES IN AN INTERNAL COMBUSTION ENGINE

BACKGROUND OF THE INVENTION

The invention is based on an oil separator for crankcase gases of an internal combustion engine, comprising a preliminary separator, a cyclone separator, a fine separator and, if necessary, a valve device that are provided in a cascade arrangement on a cylinder-head hood of the internal combustion engine.

When an internal combustion engine operates, streams of blowby gas are produced between pistons, piston rings, and cylinder walls and, if applicable, in the region of valve guides. This blowby gas—which enters the crankcase or a camshaft housing, or travels above the cylinder head or is guided there—contains fluid components, primarily fine oil droplets or motor oil components with a low boiling point. Larger oil droplets can also be contained in the crankcase gas or even in the camshaft housing gas that are produced by moving drivetrain parts, i.e., piston, connecting rod, crankshaft or camshaft. This is also referred to as "swirl oil". In order to remove the blowby gases, a venting of the crankcase—which usually extends over the camshaft housing—is provided. These gas/fluid quantities referred to as crankcase gas and occurring intermittently are separated from the fluid components by means of an oil separator and then typically directed to the intake region of the internal combustion engine. By separating the oil, dirt is prevented from accumulating in the downstream regions, and the emission of hydrocarbons is not increased in an undesired fashion.

An oil separator for crankcase gases of the generic type is made known in DE 197 00 733 A1. This publication discloses and teaches that the components of the oil separator named initially are to be located in the cylinder-head hood of the internal combustion engine. The preliminary separator and the cyclone separator are located on the inside of the cylinder-head hood, i.e., on the side of the cylinder-head hood facing the crankcase and/or camshaft housing. The fine separator and the valve device are located between two housing cover halves of the cylinder-head hood and are located downstream from the cyclone separator in terms of flow.

The known means of attaining the object of the invention entails a great deal of integration expense in terms of structurally locating the oil separator components in the cylinder-head hood. It is also very tall. Integrating it therefore depends to a large extent on the specified and always different design of the cylinder-head hood.

Based on this, the object of the present invention is to improve a generic oil separator of the known type to the extent that it is simplified in terms of design engineering and can be used with a larger number of cylinder-head hood designs.

This object is attained according to the invention with a generic oil separator by locating the preliminary separator, the cyclone separator, the fine separator and the valve device provided, if necessary, on the ouside of the cylinder-head cover, and covering them with a housing half-shell which, together with the outside of the cylinder-head hood, forms a housing for the oil separator and can be installed against the outside of the cylinder-head hood in sealing fashion. Protection is also claimed for a cylinder-head hood having an oil separator, according to the invention, mounted to the outside.

With the invention it is also proposed to locate the components of the oil separator outside the cylinder-head hood itself. This opens up the possibility of producing all components in one housing, i.e., a housing half-shell of the oil separator, as a subassembly that can be pre-assembled, and then adjoining this subassembly in entirety, in modular fashion, with or without an additional bottom part, to the outside of the cylinder-head hood. In particular, the cylinder-head hood—detached from components of the oil separator—can be installed on the cylinder head in order to seal off the top of the camshaft housing. The preassembled subassembly of the oil separator can then be installed at this time or a later time.

It is found to be particularly advantageous when the housing half-shell—which forms a housing for the oil separator—is a plastic part produced as a single component, in particular an injection-molded part.

With regard for the ability of the oil separator to be preassembled in specific subassemblies, it is found to be particularly advantageous when flow guide walls of the preliminary separator, a helical insert for the cyclone separator, a separator insert for the fine separator, and preferably the valve device as well, can be placed in the housing half-shell for preassembly. All components with regard for the housing half-shell can then be preassembled, stockpiled as ready-to-install subassemblies, and then delivered to the cylinder-head hood at the desired point in time for final assembly.

The housing half-shell should be advantageously designed rather flat and elongated in shape. To handle crankcase gases of up to 150 l/min, a diameter of only approximately 295×60×70 mm (length×width×height) has been found to be sufficient; with this, it was possible to separate oil quantities of 100 to 200 g/h. In order to obtain these quantities using non-generic, modular designs of externally adjoined cyclone separators, a much greater overall height of 175 mm and a length and width of 105×90 mm was required until now. The design according to the invention makes it possible to realize pancake-designed, elongated dimensions when configuring the oil separator in the range described hereinabove, which said dimensions are sufficient in terms of their efficacy, throughput rate, and separation capacity.

It is found to be advantageous when the housing half-shell comprises circumferential side walls extending in the direction toward the cylinder-head hood that transition into a full-perimeter, front edge facing the cylinder-head hood, with which the housing half-shell can be placed against the outside of the cylinder-head hood in sealing fashion.

This full-perimeter, front edge can advantageously define a seating plane, which then makes it necessary to design the outside of the cylinder-head hood correspondingly flat in the region where the oil separator is installed. A design of the housing half-shell of the oil separator having circumferential side walls extending in the direction toward the cylinder-head hood, i.e., having a substantially pot-shaped geometry, makes it possible in particularly advantageous fashion to preassemble all components in the protected and prefabricated housing, which then only need be joined with the outside of the cylinder-head hood via its full-perimeter edge. As an alternative or in addition, a bottom part could close the housing half-shell of the subassembly, in particular except for afflux and return openings.

The adjoining of the housing half-shell to the cylinder head-hood can be realized via lugs projecting laterally from the housing half-shell and integrally molded in particular as a single component to the housing half-shell, which lugs are then advantageously penetrated by screws that can be screwed into corresponding thread openings in the top of the cylinder-head hood. These thread openings can be formed in particular by dome-shaped raised areas on the outside of the cylinder-head hood. In the case of this exemplary embodiment, the lugs are reset behind the front edge of the housing half-shell in the direction of installation of the housing half-shell. During installation, the dome-shaped raised areas on the outside of the cylinder-head hood then form installation and centering aids during adjoining and correct positioning of the preassembled subassembly. The lugs can forms seating surfaces when the screws are tightened, which ensure correct installation. A fastening means using plastic snap-in hooks is also feasible and advantageous.

Moreover, it is found to be advantageous when the flow path is redirected substantially at a right angle downward in the direction toward the outside of the cylinder-head hood between an upwardly-opening outlet of the fine separator, i.e., in the flow direction after an outlet opening of the fine separator insert, e.g., a thread spool, and an outlet of the oil separator toward the intake device of the internal combustion engine. Due to this redirection-twice, at right angles, in particular—during emergence, as compared with an arch-shaped diversion at the level of the outlet opening of the fine separator insert (as with DE 197 00 733 A1) of the fine separator, a reduction in length, particularly by up to 20 mm, is obtained. This is referred to as a steeply-designed transfer passage between the fine separator and an outlet region of the oil separator, where the valve device for pressure regulation and limiting the crankcase gases is also provided.

In building on this inventive idea, it is found to be advantageous when a recess in the form of a necessarily provided volume of the housing half-shell is provided between a housing region enclosing the fine separator and a housing region of the housing half-shell enclosing the outlet and/or the valve device, i.e., underneath the transfer passage mentioned hereinabove, into which said recess—when the oil separator is installed—an opposed shape of the top of the cylinder-head hood-designed complementary in shape-engages. Due to this engagement, a dead volume is prevented in which oil can collect since it is the lowest point in the oil separator. This prevents a situation in which, when the engine position changes during driving, a large quantity of oil can be directed from there to the induction tract and, therefore, back to the combustion chamber.

In the case of the known oil separator according to DE 197 00 733 A1 mentioned initially, an oil return opening into the camshaft housing is formed in the region below the fine separator insert of the fine separator. In this known embodiment, fluid—particularly oil—separated in the preliminary separator and the cyclone separator travel through slanted formations in the housing and enter the housing region of the fine separator and, in this third separation step, is directed together with the fluid separated there back into the camshaft housing. According to a further independent inventive idea, it is proposed that oil separated in the preliminary separator be returned directly to the engine compartment via a further return opening. This is easily possible, because a notable pressure differential does not yet exist in the region of the preliminary separator, and the quantity of fluid separated there can simply drip or run downward, and it is not carried with the flow into the preliminary separator. In this fashion, a large portion of the fluid contained in crankcase gas, i.e., larger oil droplets, are separated out in advance and returned directly to the engine compartment. The same opening in the cylinder-head hood is preferably used for the return, running-off or dripping of this quantity of fluid as well as directing the crankcase gas into the oil separator. This opening preferably has a large opening cross-section that can comprise, for example, a draining wall—that is domed, in particular—projecting into the camshaft housing compartment, which said draining wall is formed by the cylinder-head hood.

According to a further inventive idea that is independent per se, the cyclone separator comprises a helical flow path that is formed by a helix having a cylindrical internal part that is capable of being installed on the housing half-shell, whereby the cylindrical internal part defines an inner diameter $D_i$ of the helical flow path and is stockpiled in various diameters. According to this inventive idea, protection is therefore claimed for a system of an oil separator having various helical flow paths, each having a different radial depth as measured from the cylindrical internal part to an outer diameter of the helical flow path, which said outer diameter is preferably formed by the housing half-shell. It is therefore proposed, according to the invention, to provide various flow paths through various helixes having a varying inner diameter and/or having a varying outer diameter by inserting cylindrical sleeves into the housing region that forms the cyclone separator, while maintaining the outer dimension of the cyclone separator.

If one assumes a quantity of crankcase gas of approximately 65 l/min, e.g., from a diesel engine having 2 to 2.5-l piston displacement, it is found to be advantageous when the flow path is sized such that the cylindrical internal part has a diameter of approximately 8 mm, and the outer diameter of the housing for the cyclone separator is 51 mm with a helical path height (slope) of 13 mm. With a smaller quantity of crankcase gas of only approximately 50 l/min, it is found to be advantageous if the inner diameter is approximately 18 mm, in order obtain a flow rate inside the cyclone separator that is nearly as great, due to the smaller flow cross-section. With the smallest quantity of crankcase gas typically occurring, 40 l/min, an inner diameter of approximately 24 mm should be suitable, again with a helix height (slope) of 13 mm and an outer diameter of 51 mm.

Further features, details, and advantages of the invention result from the attached claims, the drawings, and the subsequent description of a preferred exemplary embodiment of the oil separator according to the invention.

Figure 1:
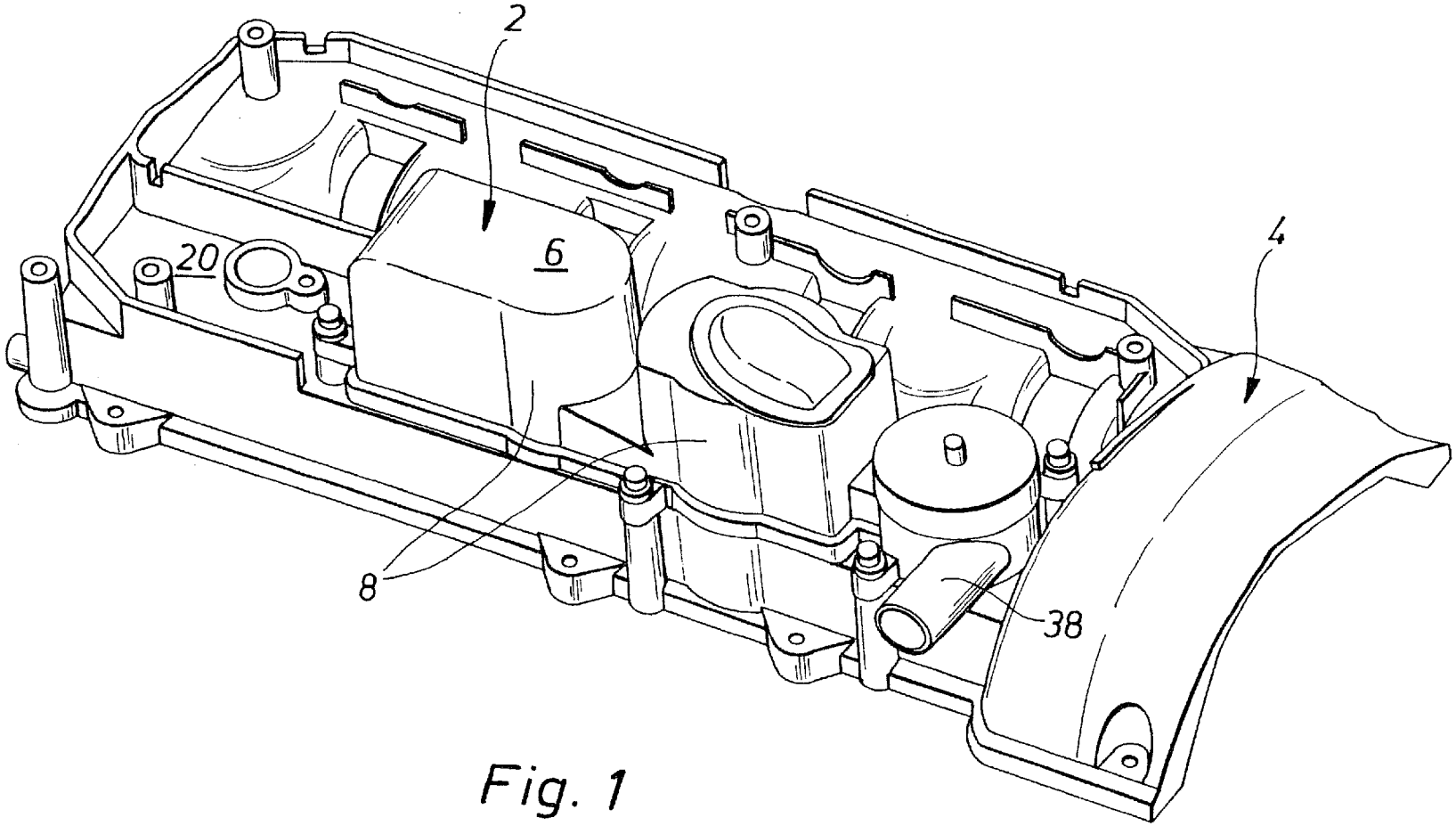
FIG. 1 is a perspective view of an oil separator according to the invention in the installed state on the outside of a cylinder-head hood.
Figure 2:
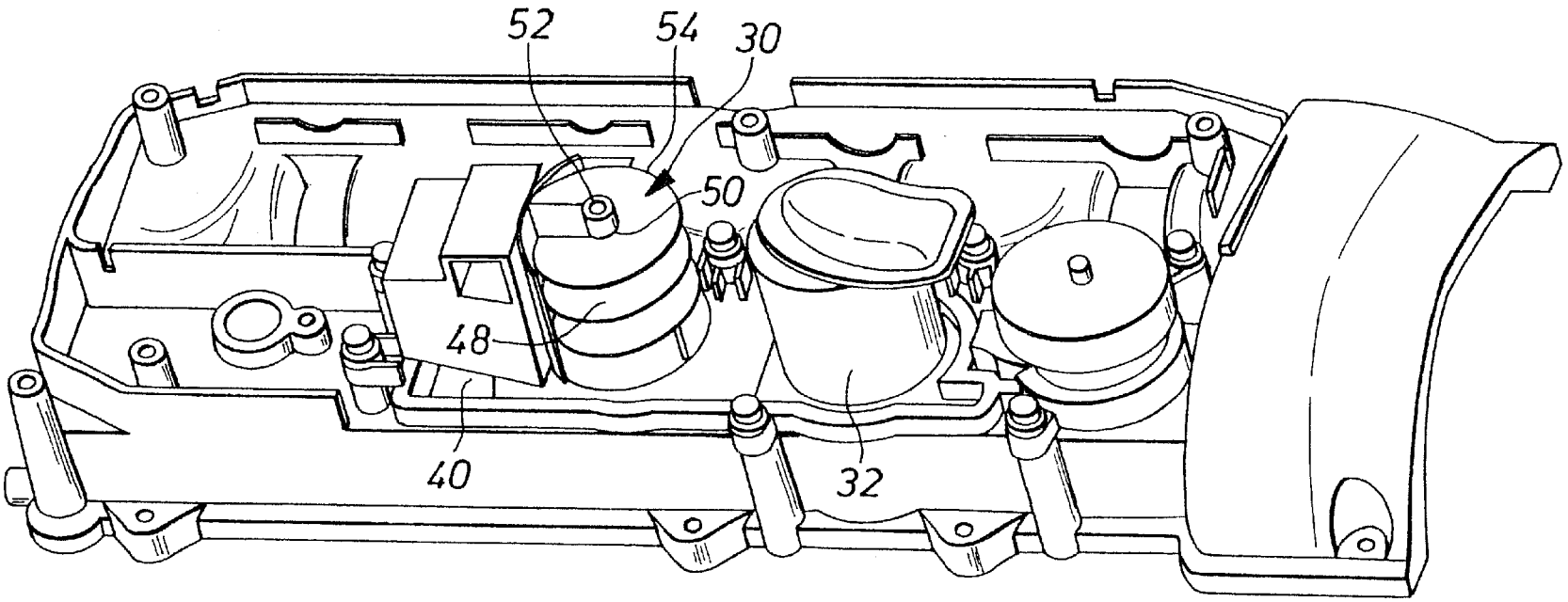
FIG. 2 is a perspective illustration according to FIG. 1 with partially cut-away walls of the oil separator.
Figure 3:
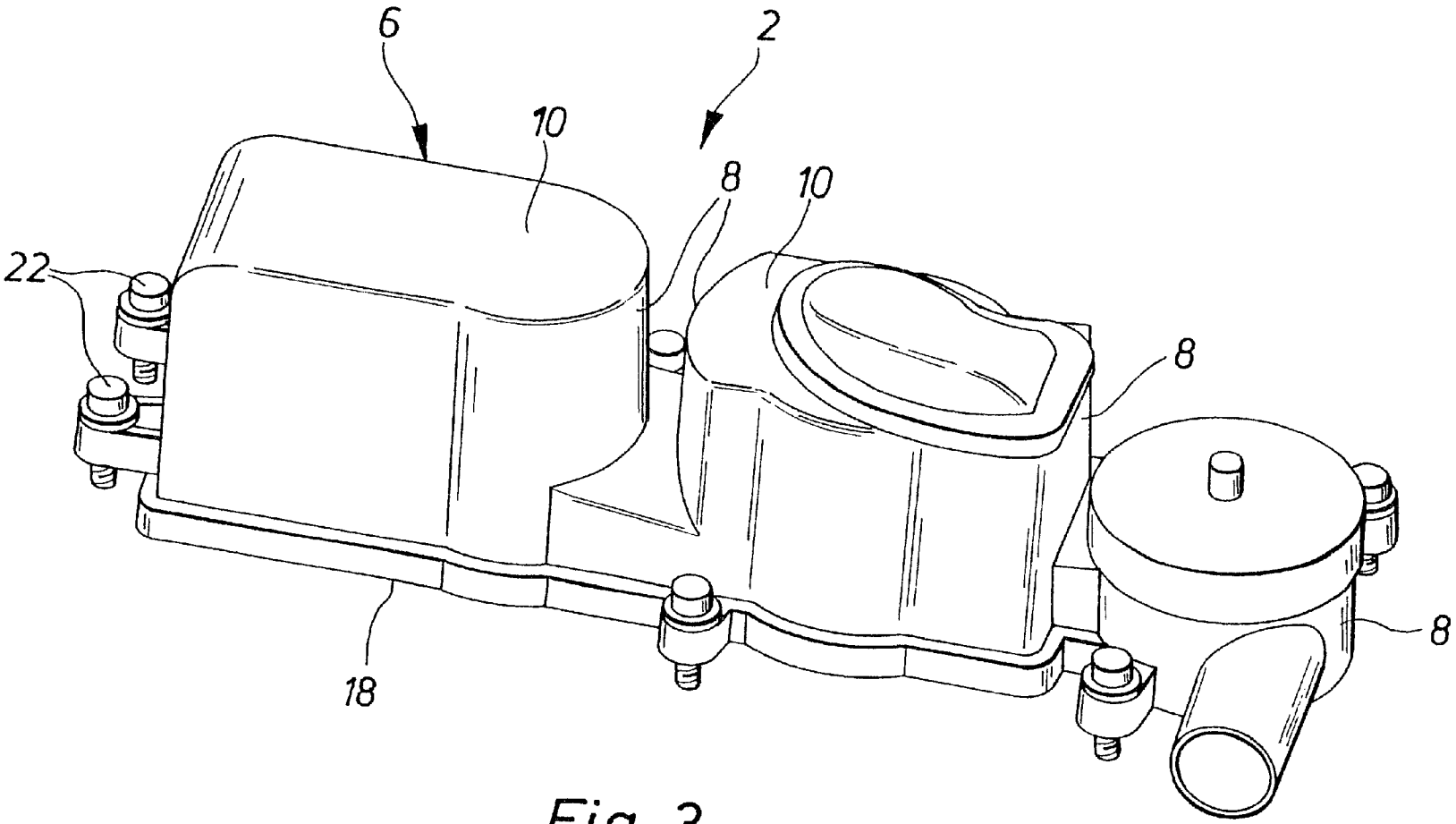
FIG. 3 is a perspective illustration of the oil separator according to FIG. 1.
Figure 4:
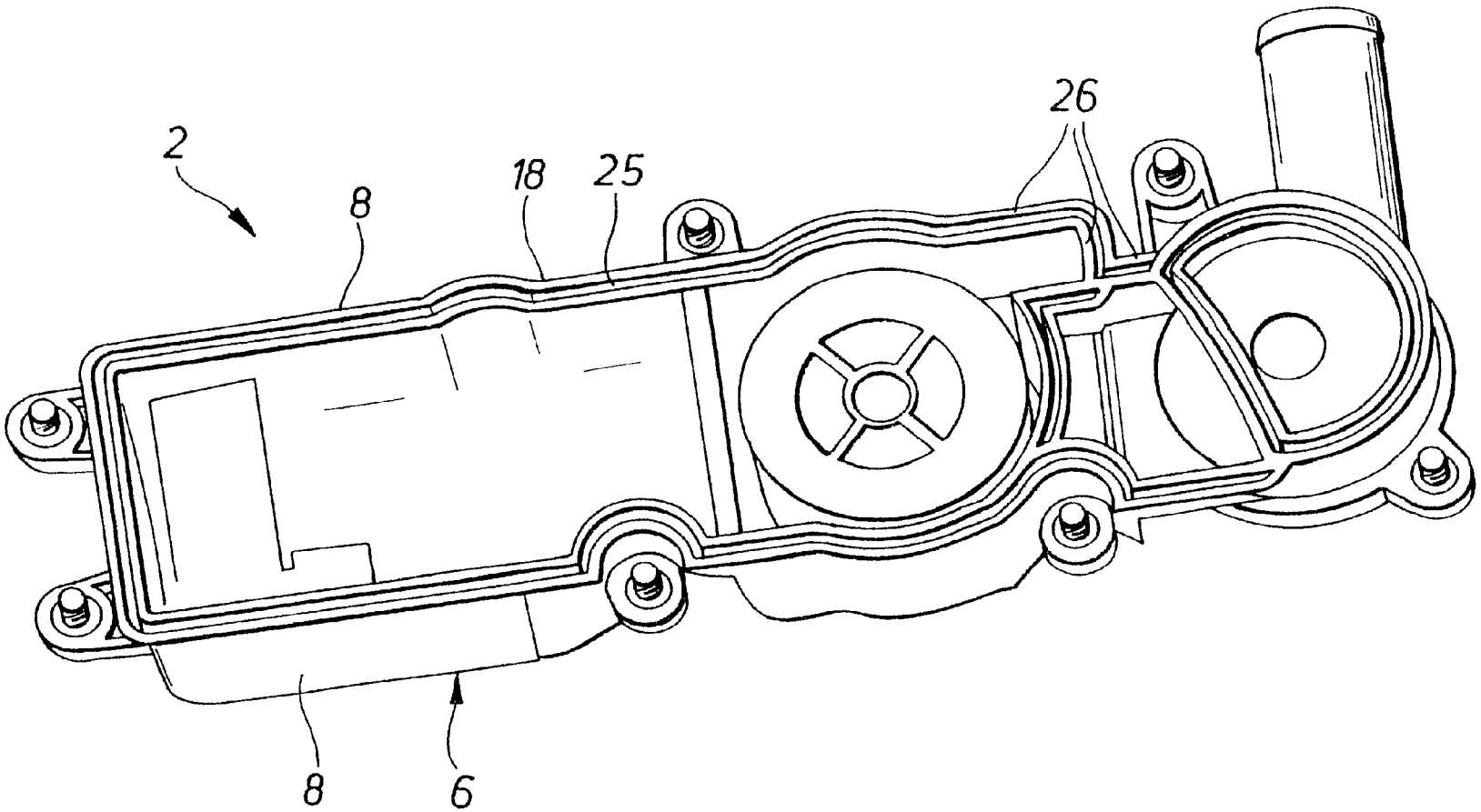
FIG. 4 is a perspective illustration of the oil separator according to FIG. 3 from below (the side to be mounted on the cylinder-head hood)
Figure 5:
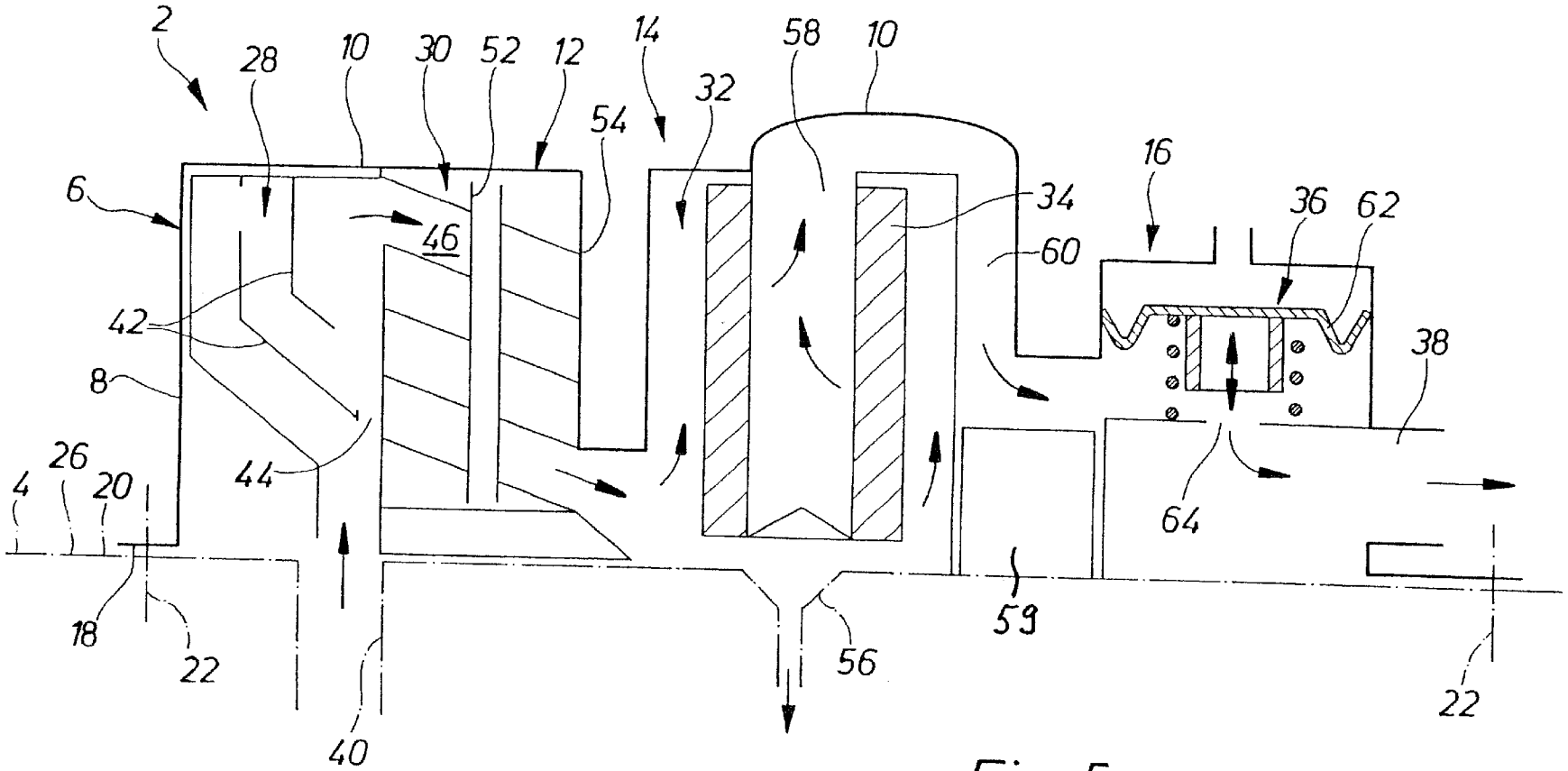
FIG. 5 is a schematic sectional view through an exemplary embodiment of the oil separator according to the invention with cylinder-head hood indicated only schematically.

FIG. 1 shows a perspective view of an oil separator 2—labelled in entirety with reference numeral 2 and to be described in detail hereinbelow—in the installed state on the outside of a cylinder-head hood—labelled in entirety with reference numeral 4—of an internal combustion engine. FIGS. 3 and 4 show a perspective view of the oil separator 2. Reference will also be made to FIG. 5 hereinbelow, which is a sectional view of the oil separator 2 shown partially schematically.

The oil separator 2 comprises a housing half-shell 6 that houses all components of the oil separator 2. The housing half-shell 6 is a plastic injection-molded part produced as a single component that comprises circumferential side walls 8 extending in the direction toward the cylinder-head hood 4. The circumferential side walls 8 start from a top cover wall 10, and a plurality of pot-shaped housing regions 12, 14, 16 are formed. The respective circumferential side walls 8 transition into a full-perimeter edge 18 on the front side, with which the housing half-shell 6 can be placed against the outside of the cylinder-head hood in sealing fashion. The housing half-shell 6 can then be screwed together with the outside 20 of the cylinder-head hood 4 via screws 22 indicated in FIG. 5 and illustrated in FIGS. 1 through 4. One can see lugs 23 of the housing half-shell 6 projecting laterally away from the circumferential side walls 8, through which the screws 22 are guided. The screws 22 are screwed into dome-shaped raised areas 24 that project out of the outside 20 of the cylinder-head hood 4. In order to seal off the interior of the housing half-shell 6, a substantially full-perimeter groove 25 for a cord seal that is not shown but that can be inserted there is formed in the edge 18 extending around the perimeter on the front.

The full-perimeter, front edge 18 forms or defines a seating plane 26. In order to place the oil separator against the outside 20 of the cylinder-head hood 4 in sealing fashion via its housing half-shell 6 and install it there, the only requirement is to design a region on the outside 20 of the cylinder-head hood 4 extending in the region of the front edge 18 correspondingly flat. No complicated adjustment procedures to cylinder-head hoods having various designs are therefore necessary. Instead, the pertinent cylinder-head hoods having various designs for various internal combustion engines need only comprise an outside designed in accordance with the housing half-shell or in accordance with its front edge 18 and, in the simplest case, one flat section (but only along the extent of the edge 18).

The housing region 12 forms a substantially pot-shaped chamber in which a preliminary oil separator 28 and a cyclone separator 30 are provided. Contained in the pot-shaped housing region 14 adjacent to this is a fine separator 32 having a fine separator insert 34 designed as a thread spool, for example. Housing region 16—which is not as tall as housing regions 12, 14—contains a valve device 36 that opens or closes an outlet 38 of the oil separator 2 to the intake side of the not-shown internal combustion engine and therefore limits the upper pressure of the crankcase gases.

The separation stages arranged in a cascade are designed as follows:

The preliminary separator 28 is located above an afflux opening 40 for crankcase gases in the cylinder-head hood 4 and comprises—as shown in FIG. 5—flow guide walls 42 that cause the crankcase gases flowing into the oil separator 2 to be redirected, preferably multiple times. Provided at the lowest point after the first redirection inside the preliminary separator 28 is a return opening 44 for fluid separated in this stage. From the return opening 44 on the bottom end of a flow guide wall 42, the separated fluid then drips downward against the flow of the crankcase case and thereby directly re-enters the engine compartment below the cylinder-head hood 4. At the top, i.e., in the region of the inside of the cover wall 10, the flowing crankcase gas enters the cyclone separator 30 located downstream in the manner of a cascade. Said cyclone separator comprises a helical flow path 46. The helical flow path 46 is formed by a helix 48 having a central opening 50 through which a tubular or cylindrical internal part 52 is inserted and is interconnected with the helix 48 substantially tightly. The circumferential edges 54 of the helix 48 bear against the inside of the circumferential side walls 8 of the housing half-shell 8 in substantially sealing fashion. In this fashion, the helical passages of the helix 48 are formed and limited by the internal part 52, and the helical flow paths 46 are formed and limited by the housing half-shell 6. Due to forces of inertia, the fluid components in the helically-flowing crankcase gas are separated radially outwardly, and they flow down the helical path because of their weight.

The radial depth of the helical flow path 46 can be varied in particularly advantageous fashion. This can take place, in particular, by inserting various helixes 48 having various radial depths, which is preferably achieved using variously-sized internal parts 52 of the helix 48 while the outer diameter of the helix 48 remains the same. In this manner, a different flow cross-section can be obtained by selecting and inserting different helixes, in order to adjust for various engines and applications while the structural design and dimensions of the oil separator 2 otherwise remain the same.

The fine separator 32, which is located in the housing region 14 downstream in terms of flow, comprises a cylindrical thread spool as the fine separator insert 34 that is closed on its side closest to the cylinder head. The flowing crankcase gases pass through the cylindrical wall of the thread spool, whereby the remaining ultra-fine fluid droplets are separated out and, because of their weight, move downward inside the thread spool in the direction toward the cylinder-head hood. An oil drain opening 56—indicated only schematically in FIG. 5—is provided there in the cylinder-head hood. The thread spool comprises an outlet opening 58 on its top end. The cover wall 10 is arched somewhat upwardly in this region. The crankcase gases flowing through the outlet opening 58 are then redirected by 90° directly in the region of the dome, but then they are redirected once more downwardly by 90° in the direction toward the cylinder-head hood 4. By designing the domed part 10 as a separate component, production of the housing half-shell 6 is greatly simplified with regard for forming expense. Due to the very steep design of the transfer passage 60, the space required in the longitudinal direction is kept to a minimum. An opposed shape 59 projects into a recess between the housing regions 14 and 16—that is formed on the cylinder-head hood—so that no dead volume forms in which fluid could collect. Exiting the transfer passage 60, the flowing crankcase gas enters the housing region 16, where the valve device 36 is provided. The valve device 36 comprises a diaphragm 62—indicated schematically in FIG. 5—which is open to the atmosphere on one side and is acted upon by crankcase gas on the other. When the internal combustion engine undergoes maximum induction, i.e., when a maximum vacuum exists in the outlet 38 of the oil separator, the valve device 36 closes an opening 64 and, in fact, under the pressure from the atmosphere. If the pressure underneath the membrane 62 increases due to the crankcase gas, the opening 64 is opened, and crankcase gases are directed to (renewed) combustion.

Figure 6:
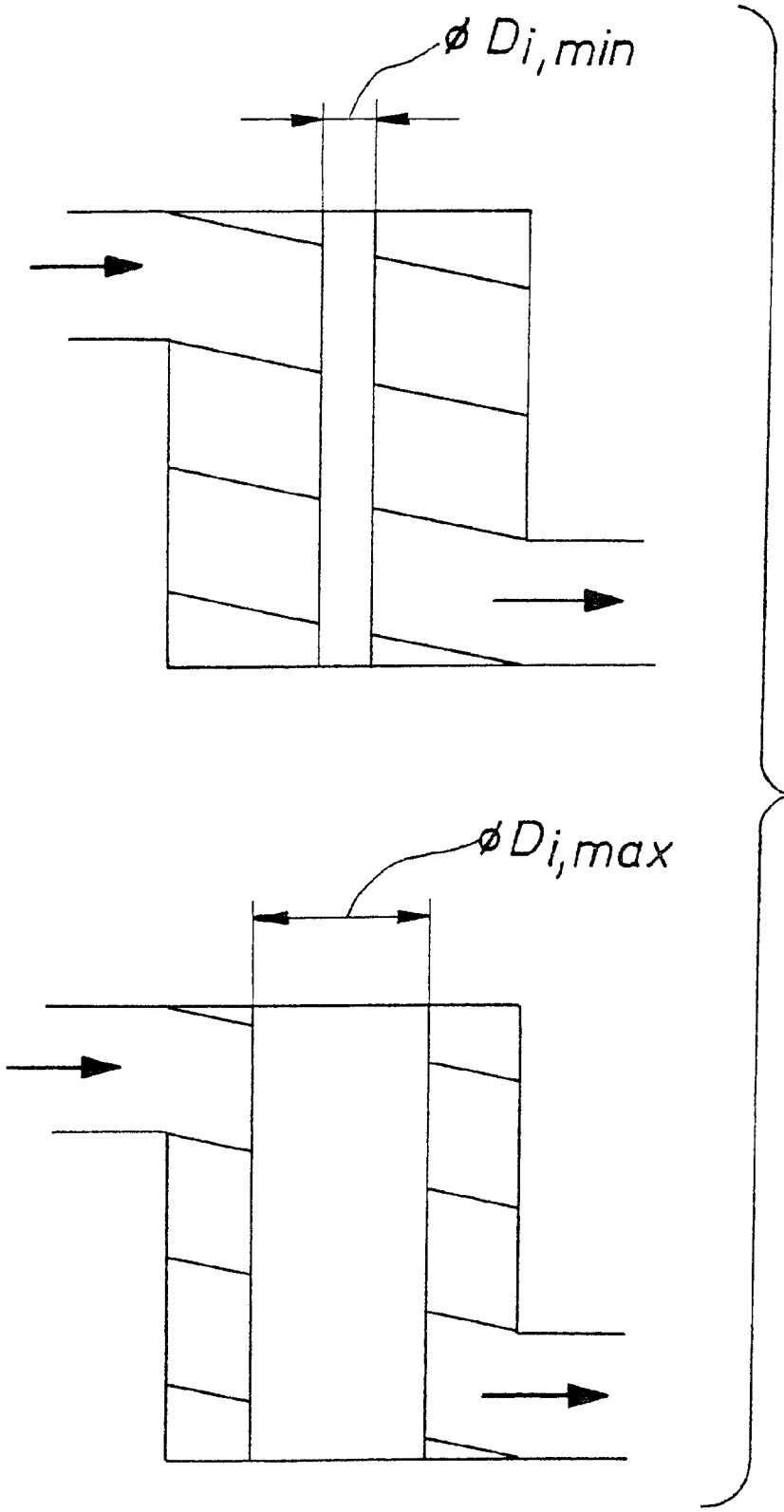
FIG. 6 shows two schematic illustrations of different helical inserts for the oil separator according to FIG. 4.

FIG. 6 shows a schematic illustration of two different embodiments of helixes 48 having different radial depths of the flow path that are obtained by means of cylindrical internal parts 52 having different diameters, while the outer diameter of the helix 48 remains the same.

What is claimed is:

1. An oil separator (2) for crankcase gases of an internal combustion engine, comprising a preliminary separator (28), a cyclone separator (30), a fine separator (32) and, if necessary, a valve device (36) that are provided in a cascade arrangement on a cylinder-head cover (4) of the internal combustion engine, wherein the preliminary separator (28), the cyclone separator (30), the fine separator (32) and the valve device (36) provided, if necessary, are located on the outside (20) of the cylinder-head hood (4) and are covered by a housing half-shell (6) which, together with the outside (20) of the cylinder-head hood (4), forms a housing for the oil separator (2).

2. The oil separator according to claim 1, wherein the housing half-shell (6) is a plastic part produced as a single component, in particular an injection-molded part.

3. The oil separator according to claim 1, wherein flow guide walls (42) and/or a helical insert (48) for the cyclone separator (30) and/or a separator insert (34) for the fine separator (32) and/or the valve device (36) can be placed in the housing half-shell (6) for preassembly.

4. The oil separator according to claim 1, wherein the housing half-shell (6) is sealed against the outside (20) of the cylinder-head hood (4) by means of a full-perimeter sealing element.

5. The oil separator according to claim 1, wherein the housing half-shell (6) comprises circumferential side walls (8) extending in the direction toward the cylinder-head hood (4) that transition into a full-perimeter, front edge (18) with which the housing half-shell (6) can be placed against the outside (20) of the cylinder-head hood (4) in sealing fashion.

6. The oil separator according to claim 5, wherein the full-perimeter, front edge (8) forms or defines a seating plane (26).

7. The oil separator according to claim 1, wherein the housing half-shell (6) comprises laterally-projecting, preferably integral lugs (23) that are penetrated by screws (22), or a fastening by means of elements that catch, snap in place, or latch in any other fashion is provided.

8. The oil separator according to claim 7, wherein the lugs (23) form final seating surfaces when the screws (22) are tightened.

9. The oil separator according to claim 1, wherein the flow path is redirected essentially at a right angle downward in the direction toward the outside (20) of the cylinder-head hood (4) between an upwardly opening outlet (58) of the fine separator (32) and an outlet (38) of the oil separator.

10. The oil separator according to claim 1, wherein a recess is provided between a housing region (14) enclosing the fine separator (32) and a housing region (16) of the housing half-shell (6) enclosing the outlet (38) and/or the valve device (36), into which said recess—when the oil separator is installed—an opposed shape (59) of the cylinder-head hood surface having a complementary shape engages.

11. The oil separator according to claim 1, wherein an oil drain opening (44) is provided in the flow or cascade direction upstream from the cyclone separator (30), through which oil separated in the preliminary separator (28) can be removed from the flow path.

12. The oil separator according to claim 1 having at least two helixes (48) with different radial depths of flow path, which can be optionally inserted into a housing region (14) of the housing half-shell (6) enclosing the cyclone separator while all other outer dimensions of the cyclone separator (30) remain the same.

13. The oil separator according to claim 12, wherein the cyclone separator (30) comprises a helical flow path (46) that is formed by a helix having a cylindrical internal part (52), which can be installed on the housing half-shell (6), whereby the cylindrical internal part (52) defines an inner diameter $D_i$ of the helical flow path (46).

14. The oil separator according to claim 11, wherein the maximum inner diameter $D_{i,max}$ of a cyclone separator (30) having a helical path height of 11–15 mm and an outer diameter $D_o$ of 48–54 mm is approximately 8 mm (±10%).

15. The oil separator according to claim 11, wherein the maximum inner diameter $D_{i,\,max}$ of a cyclone separator (30) having a helical path height of 11–15 mm and an outer diameter $D_o$ of 48–54 mm is approximately 18 mm (±10%).

16. The oil separator according to claim 11, wherein the maximum inner diameter $D_{i,\,max}$ of a cyclone separator (30) having a helical path height of 11–15 mm and an outer diameter $D_o$ of 48–54 mm is approximately 24 mm (±10%).

* * * * *